US009027273B1

(12) United States Patent
Clinkenbeard

(10) Patent No.: US 9,027,273 B1
(45) Date of Patent: May 12, 2015

(54) HANDLE FOR A RIFLE WITH A SCOPE

(76) Inventor: Chuck Clinkenbeard, Plaines, MT (US)

( * ) Notice: Subject to any disclaimer, the term of this patent is extended or adjusted under 35 U.S.C. 154(b) by 0 days.

(21) Appl. No.: 13/475,327

(22) Filed: May 18, 2012

Related U.S. Application Data

(60) Provisional application No. 61/488,471, filed on May 20, 2011.

(51) Int. Cl.
*F41C 33/08* (2006.01)
*F41C 23/16* (2006.01)

(52) U.S. Cl.
CPC *F41C 33/08* (2013.01); *F41C 23/16* (2013.01)

(58) Field of Classification Search
USPC ..... 42/85, 90, 124, 125, 126, 72; 89/1.42
See application file for complete search history.

(56) References Cited

U.S. PATENT DOCUMENTS 2,369,052 A * 2/1945 Ironside ..... 89/1.42
3,178,823 A * 4/1965 Lipski ..... 42/126
3,611,607 A * 10/1971 Donnell ..... 42/106
3,618,249 A * 11/1971 Grandy ..... 42/73
3,939,589 A * 2/1976 Tellie ..... 42/71.01
4,321,765 A * 3/1982 Gillum ..... 42/72
4,707,772 A * 11/1987 Jimenez et al. ..... 362/110
4,827,652 A * 5/1989 Martin ..... 42/142
D302,454 S * 7/1989 Lee ..... D22/108
5,027,542 A * 7/1991 Simonetti ..... 42/72
5,417,002 A * 5/1995 Guerra ..... 42/72
5,694,712 A * 12/1997 Plonka ..... 42/124
6,250,194 B1 * 6/2001 Brandl et al. ..... 89/1.41
6,295,754 B1 10/2001 Otteman et al.
6,336,285 B1 * 1/2002 Baumer ..... 42/124
6,397,507 B1 * 6/2002 Marshall et al. ..... 42/72
6,886,288 B1 5/2005 Yocum et al.
7,643,132 B2 1/2010 Holmberg
2003/0154641 A1 * 8/2003 Stover ..... 42/124
2004/0257437 A1 12/2004 Lesseu
2010/0236389 A1 * 9/2010 Larson et al. ..... 89/1.42

FOREIGN PATENT DOCUMENTS

DE 3423320 A 6/1984

* cited by examiner

*Primary Examiner* — Bret Hayes
(74) *Attorney, Agent, or Firm* — Jean Kyle

(57) ABSTRACT

A handle attaches to the mount of a rifle scope. The handle is attached to the upper rings of the scope mount to provide a handle by which a hunter can carry the rifle. The handle discourages the hunter from using the scope as a handle.

6 Claims, 4 Drawing Sheets

HANDLE FOR A RIFLE WITH A SCOPE

CROSS-REFERENCE TO RELATED APPLICATIONS

This application claims the benefits of U.S. Provisional Application No. 61/488,471, filed May 20, 2011, the disclosure of which is hereby incorporated by reference in its entirety including all figures, tables and drawings.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

A hunter's day can be long and tiring. While pursuing their pray, a hunter may have to scale the side of a mountain or climb over a fence. Rifles carried on a sling can encumber this movement. Using a rifle scope as a handle is a popular way to carry a rifle. It allows the hunter to carry the rifle away from the body freeing movement and is a quick way to grab the rifle. The rifle scope however is mounted to elongate the sight of the shooter not to provide a handle. Therefore, the rifle scope does not offer adequate space for gloved fingers to curl around the scope. Further, using the rifle scope as a handle could jar scope components effecting the hunter's accuracy.

Handles are provided on automatic weapons such as the M16. While these weapons do not normally have scopes, devices for mounting a scope to the handles of these rifles have been described (see, for example, U.S. Pat. Nos. 6,295,754 B1; and 6,886,288 B1). A sight for a hand gun has been described that has an integrated carrying handle (DE 342330). Cameras and range finders have been described mounted to a rifle scope (U.S. Pat. No. 7,643,132 B2; and U.S. Patent Application Publication No. 2004/0257437 A1) yet never to a handle.

There remains a need for a handle that allows a hunter to firmly grip a rifle away from their body while climbing over a fence or scaling a hill. The handle should be easy to apply, should not interfere with the function of the scope, and should not permanently alter the rifle.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention involves a handle that is applied to the mount of a scope of a rifle. The handle mount replaces the upper rings on the scope mount to attach the handle securely over the scope. In preferred embodiments, the handle and mounting means adjust to accommodate a variety of scope mounts.

DETAILED DESCRIPTION OF THE INVENTION

The invention involves a handle that is applied to the scope mount of a rifle to position the handle above the scope. A grip is attached to the scope mount by mounting means.

The handle of the subject invention has a grip 10. The grip 10 can be any configuration and made of any material durable enough to withstand the conditions to which the rifle will be exposed. In a preferred embodiment, the grip is configured to facilitate a strong grasp. For example, the grip can be provided with finger detents as shown in the exemplified embodiments. The grip can likewise comprise rubberized materials to aid the grasp of the hunter's hand. The circumference and shape of the grip can further be manipulated to facilitate grasp. One skilled in the art will recognize that it is advantageous to provide a grip for the subject handle that complies with ergonomic principles.

The handle of the subject invention is applied to the scope mount of a rifle by mounting means 12. The base 14 of the mounting means are saddles that replace the upper ring portions (not shown) of the scope mount. The saddles attach the handle to the scope mount using the screws that secure the upper ring portions of the scope mount to the lower ring portions. The base 14 supports the arms 18 of the mounting means 12 which connect to the grip 10. In the exemplified embodiments, the grip spans two arms. Applicant notes however that the grip can be supported by only one arm to provide an open handle that may be more easily accessible by a gloved hand. In this configuration, to stabilize the handle, the bases of the handle would be connected to one another.

Figure 1:
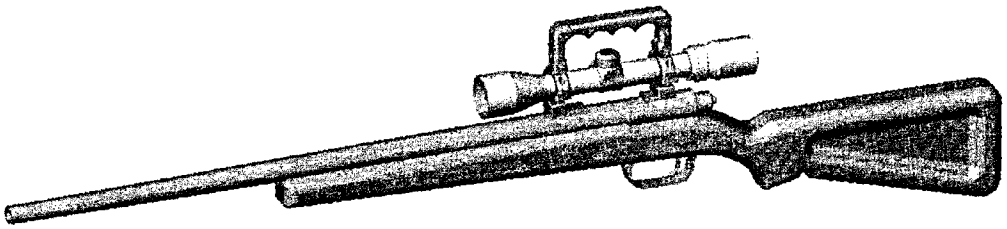
FIG. 1 is a side elevational view of a preferred embodiment of the handle of the subject invention installed on a rifle above the rifle scope.
Figure 2:
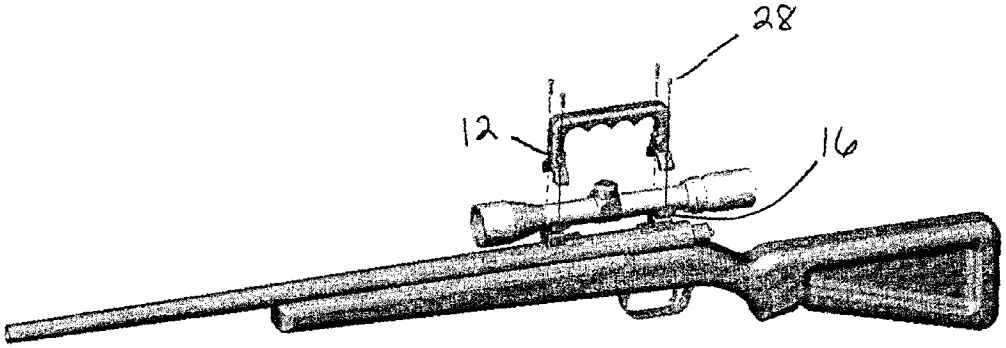
FIG. 2 is an exploded view of the preferred embodiment of the handle shown in FIG. 1.
Figure 3:
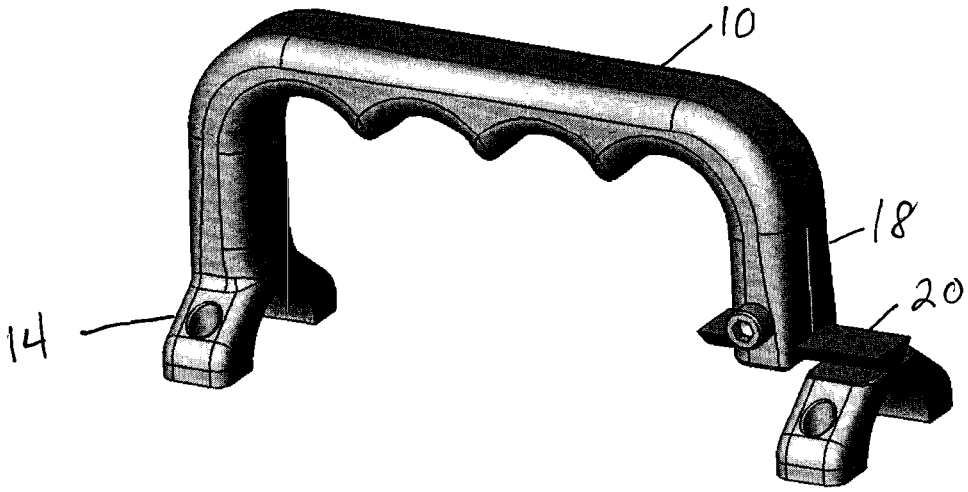
FIG. 3 is a side perspective view of a preferred embodiment of the handle of the subject invention.
Figure 4:
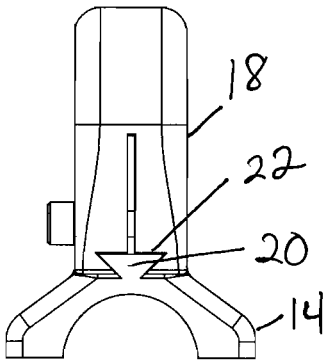
FIG. 4 is a rear elevational view of the preferred embodiment of the handle shown in FIG. 3.
Figure 5:
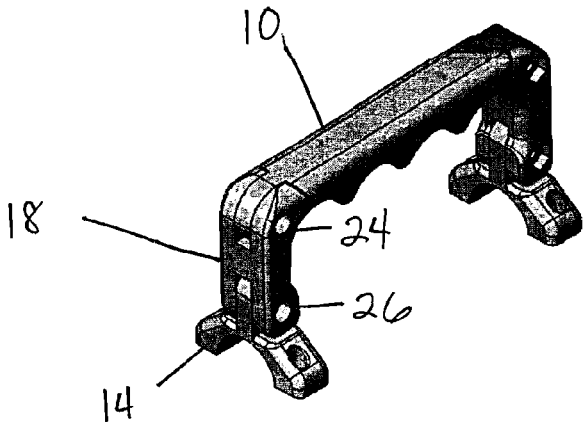
FIG. 5 is a top perspective view of another preferred embodiment of the handle of the subject invention.
Figure 6:
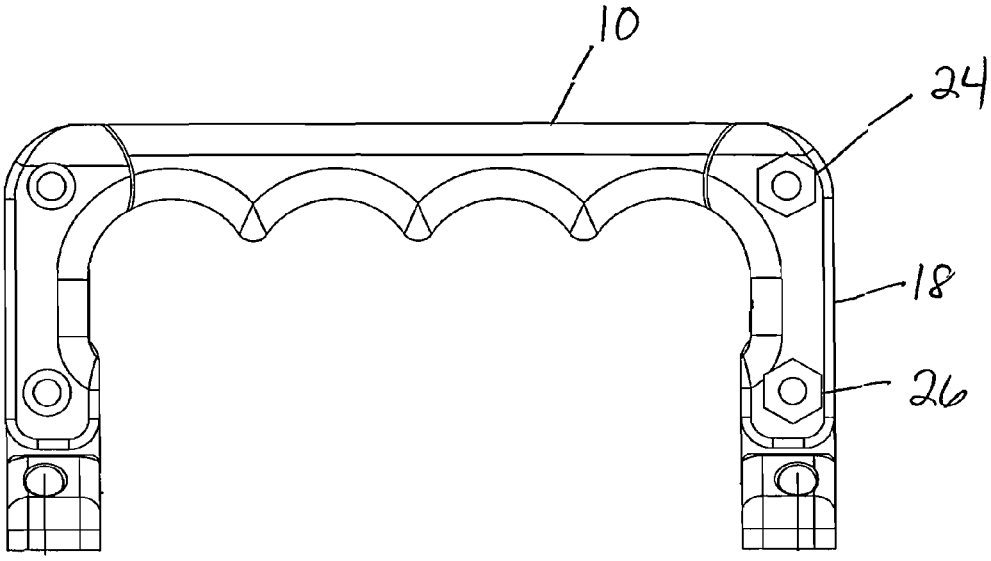
FIG. 6 is a side elevational view of the handle shown in FIG. 5.
Figure 7:
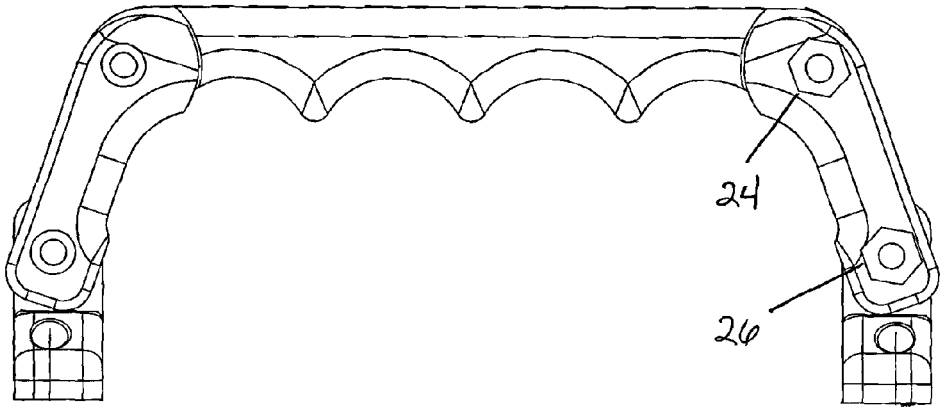
FIG. 7 is a side elevational view of the handle shown in FIG. 5 spread to be mounted on a rifle.
Figure 8:
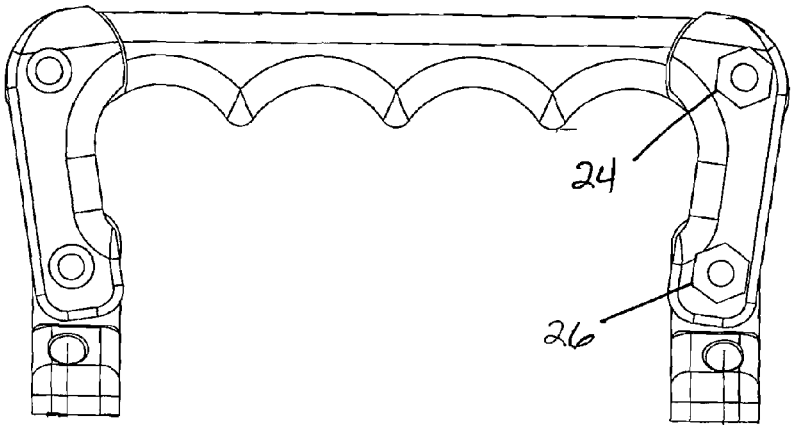
FIG. 8 is a side elevational view of the handle shown in FIG. 5 compressed to be mounted on a rifle.

In the simplest embodiment, the grip 10, arms 18, and bases 14 can be integral and form a single unit. In preferred embodiments however the handle of the subject invention is adaptable to a variety of scope mounts and rifles. FIGS. 3 and 4 show a preferred embodiment of an adjustable handle. In this embodiment, at least one base 14 of the mounting means 12 comprises a tenon 20 that dovetails into a mortise 22 on an arm 18 of the handle. The arm is moved along the tenon allowing the bases to be attached to a variety of scope mounts which may vary in the distances between their rings.

Another preferred embodiment of an adjustable handle is shown in FIGS. 5-8. In this embodiment, the arms 18 of the subject handle are articulated with joints connecting the arm to the grip 10 and to the base 14. The joint connecting the arm to the grip 24 allows the mounting means to move and spread (FIG. 7) or compress (FIG. 8) to accommodate a scope mount that has a greater or lesser distance between its rings. The joint connecting the arm to the base 26 positions the base for connection to the scope mount no matter the position of the arms. This adjustable handle can have only one articulated arm or both arms can be articulated, as shown. Lockable joints provide a reliable handle while allowing the joints to be freed so the handle can be folded down when not in use.

The handle of the subject invention should be made of materials that will endure the elements and conditions to which the rifle is submitted. The materials should be lightweight and preferably are resistant to rust and corrosion. The materials should not be effected by the heat and cold. It should not shatter in the cold or melt or warp in the heat and moisture. Joints are preferably constructed to be maintenance free and designed so they are not soiled by dirt or brush. Suitable materials for the handle of the subject invention include, but are not limited to, plastics, composites, and aluminum.

To install the handle of the subject invention on a rifle, the upper rings (not shown) of the scope mount are removed by unscrewing them from the lower rings 16 of the mount. The handle is installed on the scope mount by using the removed screws 28 to connect the base pieces 14 of the handle to the lower rings 16 of the scope mount. One skilled in the art will realize that other screws or fasteners can be used that effectively secure the base pieces to the scope mount. The handle is securely mounted to the rifle and does not interfere with the scope. While the handle of the subject invention is shown on a rifle that has a scope, it is apparent that the rifle need not have a scope to use the subject handle but merely must have the scope mount to which the handle can attach.

The handle of the subject invention provides a convenient means by which hunters can carry their rifles. The handle is lightweight and does not interfere with the function of the rifle or the scope.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A handle for a rifle with a scope, the handle comprising:

a saddle configured to attach to at least one lower ring of a scope mount;

an arm extending from and supported by the saddle, the arm connected to the saddle by an articulating joint; and a grip supported by the arm, the grip connected to the arm by another articulating joint;

wherein the saddle replaces an upper ring of the scope mount and wherein the grip is of a length to allow adequate room to receive a hand of a user to grasp the grip and the arm is of a length to allow adequate room to receive fingers of the hand of the user grasping the grip, the grip and arm providing a handle for the rifle with a scope and wherein at least one of the articulating joint and the other articulating joint is lockable.

2. A handle for a rifle with a scope mount, the handle comprising:

a first saddle capable of attaching to one lower ring of a scope mount, and a second saddle capable of attaching to another lower rings of the scope mount;

a first arm extending from and supported by the first saddle, and a second arm extending from and supported by the second saddle, at least one of the first arm and the second arm connected to the saddle by a first articulating joint; and a grip spanning and supported by the first arm and the second arm, the at least one arm connected to the saddle by the first articulating joint also connected to the grip by a second articulating joint;

wherein the first saddle and the second saddle replace upper rings of the scope mount and wherein the grip is of a sufficient length to allow adequate room to receive a hand of a user to grasp the grip and the first arm and the second arm are of a length to allow adequate room to receive the fingers of the hand of the user grasping the grip, the grip and arms providing a handle for the rifle with a scope.

3. The handle of claim 2, wherein at least one of the first articulating joint and the second articulating joint is lockable.

4. The handle of claim 2, wherein said first arm is connected to said first saddle by said first articulating joint and said first arm is connected to said grip by said second articulating joint and said second arm is connected to said second saddle by a third articulating joint and said second arm is connect to said grip by a fourth articulating joint.

5. The handle of claim 4, wherein at least one of said first articulating joint, said second articulating joint, said third articulating joint, and said fourth articulating joint is lockable.

6. The handle of claim 2, wherein said lengths of said first arm and said second arm are about one-half of said length of said grip.

* * * * *